US011022916B2

(12) United States Patent
Murakami

(10) Patent No.: US 11,022,916 B2
(45) Date of Patent: Jun. 1, 2021

(54) IMAGE FORMING APPARATUS, RECORDING MEDIUM. AND CONTROL METHOD FOR REDUCING PRESSURE GRADIENT BETWEEN ROLLERS

(71) Applicant: Konica Minolta, Inc., Tokyo (JP)

(72) Inventor: Daisuke Murakami, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/839,571

(22) Filed: Apr. 3, 2020

(65) Prior Publication Data

US 2020/0333731 A1 Oct. 22, 2020

(30) Foreign Application Priority Data

Apr. 18, 2019 (JP) ..... JP2019-079537

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS

2009/0092425 A1* 4/2009 Hayashi ..... G03G 15/206 399/329
2013/0016996 A1* 1/2013 Yuasa ..... G03G 15/161 399/121

FOREIGN PATENT DOCUMENTS

JP 2008-287137 A 11/2008
JP 2012-047810 A 3/2012

* cited by examiner

*Primary Examiner* — Victor Verbitsky
(74) *Attorney, Agent, or Firm* — Squire Patton Boggs (US) LLP

(57) ABSTRACT

An image forming apparatus according to the present invention includes: a driver that presses and separates two rollers via a belt; a detector that detects a position of the belt in an axial direction of one roller of the two rollers; and a hardware processor that calculates, based on a detection result by the detector, a first movement amount of the position of the belt in the axial direction when the belt is made to travel for a predetermined time in a state where the two rollers are separated and a second movement amount of the position of the belt in the axial direction when the belt is made to travel for the predetermined time in a state where the two rollers are pressed.

15 Claims, 11 Drawing Sheets

FIG.6

| | Effect on belt movement distance | |
|---|---|---|
| | Effect by rollers other than target roller pair | Effect by pressure gradient of target roller pair |
| At time of separation of target roller pair (first movement distance) | Effect | No effect |
| At time of pressing of target roller pair (second movement distance) | Effect | Effect |

FIG.7

| Second movement distance - First movement distance [mm] | Pressure gradient between rollers [N] | Positional deviation of roller shaft [mm] |
|---|---|---|
| -2 | +10 | +0.5 |
| -1 | +5 | +0.25 |
| 0 | 0 | 0 |
| +1 | -5 | -0.25 |
| +2 | -10 | -0.5 |

Rear lift-up amount: 0mm
Front lift-up amount: 0mm

Rear lift-up amount: 2mm
Front lift-up amount: 3mm

Rear lift-up amount: 3mm
Front lift-up amount: 2mm

Rear lift-up amount: 2.5mm
Front lift-up amount: 2.5mm

IMAGE FORMING APPARATUS, RECORDING MEDIUM. AND CONTROL METHOD FOR REDUCING PRESSURE GRADIENT BETWEEN ROLLERS

CROSS-REFERENCE TO RELATED APPLICATION

Japanese patent application No. 2019-079537 filed on Apr. 18, 2019, including description, claims, drawings, and abstract the entire disclosure is incorporated herein by reference in its entirety.

BACKGROUND

1. Technological Field

The present invention relates to an image forming apparatus, a recording medium storing a control program for the image forming apparatus, and a control method for the image forming apparatus.

2. Description of the Related Art

The image forming apparatus is provided with a roller pair for performing sheet conveyance and image formation. It is desirable that in two rollers of the roller pair, the pressure between the rollers at the time of pressing is uniform in the axial direction of the rollers, and if the pressure is not uniform, a problem such as a paper jam or poor quality of the printed matter is caused. Such a problem becomes noticeable when the basis weight of the sheet is relatively large or conversely when the basis weight is relatively small. Also, the higher the printing speed, the more noticeable.

However, due to machine tolerance, a pressure gradient may occur in which the pressure between the rollers inclines in the axial direction of the rollers due to a positional deviation of the roller shaft of the roller pair in a pressing direction or the like.

As a prior art for detecting such a pressure gradient, the following technology is described in Unexamined Japanese Patent Publication No. 2012-47810. By pressing a transfer roll on a photosensitive drum of a toner transfer source via an intermediate transfer belt of a toner transfer destination, a toner is transferred to the intermediate transfer belt. Then, the gradient of pressing force in the axial direction of the transfer roll is detected by detecting, with an optical sensor, the density difference of the toner transferred to the intermediate transfer belt at a plurality of different positions in the axial direction of the transfer roll. Further, the following technology is described in Unexamined Japanese Patent Publication No. 2008-287137. After the toner on the intermediate transfer body is transferred to a sheet at the nip formed by bringing the transfer member into contact with the intermediate transfer body, the residual toner densities at two locations near both axial ends on the intermediate transfer body are detected with the optical sensor. If any of the toner densities is higher than a threshold value, it is determined that a contact failure has occurred.

SUMMARY

However, the above-described prior art has a problem that even when the cause of the difference in toner density in the axial direction between the rollers or the like is not the pressure gradient in the axial direction between the rollers, it is determined that the pressure gradient is the cause. In this case, even when the pressure gradient is corrected, problems such as a difference in toner density cannot be solved. In addition, since the pressure gradient in the axial direction between the rollers cannot be detected unless the toner is actually transferred, there is a problem that the operation is complicated. Further, there is a problem that it is impossible to cope with a case where the influence of the pressure gradient in the axial direction between the rollers occurs only in the conveyance of the sheet such as a paper jam.

The present invention has been made to solve such a problem. That is, an object of the present invention is to provide an image forming apparatus a recording medium storing a control program for the image forming apparatus, and a control method for the image forming apparatus, which can easily and accurately reduce the pressure gradient in the axial direction between rollers, a recording medium storing a control program for the image forming apparatus, and a control method for the image forming apparatus.

To achieve at least one of the abovementioned objects, according to an aspect of the present invention, the image forming apparatus, the recording medium storing the control program for the image forming apparatus, and the control method for the image forming apparatus reflecting one aspect of the present invention comprises the following.

An image forming apparatus comprising: a driver that presses and separates two rollers via a belt; a detector that detects a position of said belt in an axial direction of one roller of said two rollers; and a hardware processor that calculates, based on a detection result by said detector, a first movement amount of the position of said belt in said axial direction at time of traveling of said belt in a state where said two rollers are separated and a second movement amount of the position of said belt in said axial direction at the time of traveling of said belt in a state where said two rollers are pressed.

A non-transitory computer-readable storage medium storing a control program for an image forming apparatus which includes a driver that presses and separates two rollers via a belt and a detector that detects a position of said belt in an axial direction of one roller of said two rollers, the control program causing a computer to perform: a process having a procedure of calculating, based on a detection result by said detector, a first movement amount of the position of said belt in said axial direction when said belt is made to travel for a predetermined time in a state where said two rollers are separated and a second movement amount of the position of said belt in said axial direction when said belt is made to travel for said predetermined time in a state where said two rollers are pressed.

A control method of an image forming apparatus which includes a driver that presses and separates two rollers via a belt and a detector that detects a position of said belt in an axial direction of one roller of said two rollers, the method comprising: calculating, based on a detection result by said detector, a first movement amount of the position of said belt in said axial direction when said belt is made to travel for a predetermined time in a state where said two rollers are separated and a second movement amount of the position of said belt in said axial direction when said belt is made to travel for said predetermined time in a state where said two rollers are pressed.

The objects, features, and characteristics of this invention other than those set forth above will become apparent from the description given herein below with reference to preferred embodiments illustrated in the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 6 is a diagram illustrating an effect on a belt movement amount by a pressure gradient at the time of pressing a target roller pair that can be separated via the belt and an effect on the belt movement amount by rollers other than the target roller pair about each of the time of separation and the time of pressing the target roller pair;

FIG. 7 is a diagram illustrating a relation between a difference between a first movement amount and a second movement amount, and the parallelism between rollers and the pressure gradient between rollers;

DETAILED DESCRIPTION OF EMBODIMENTS

Figure 1:
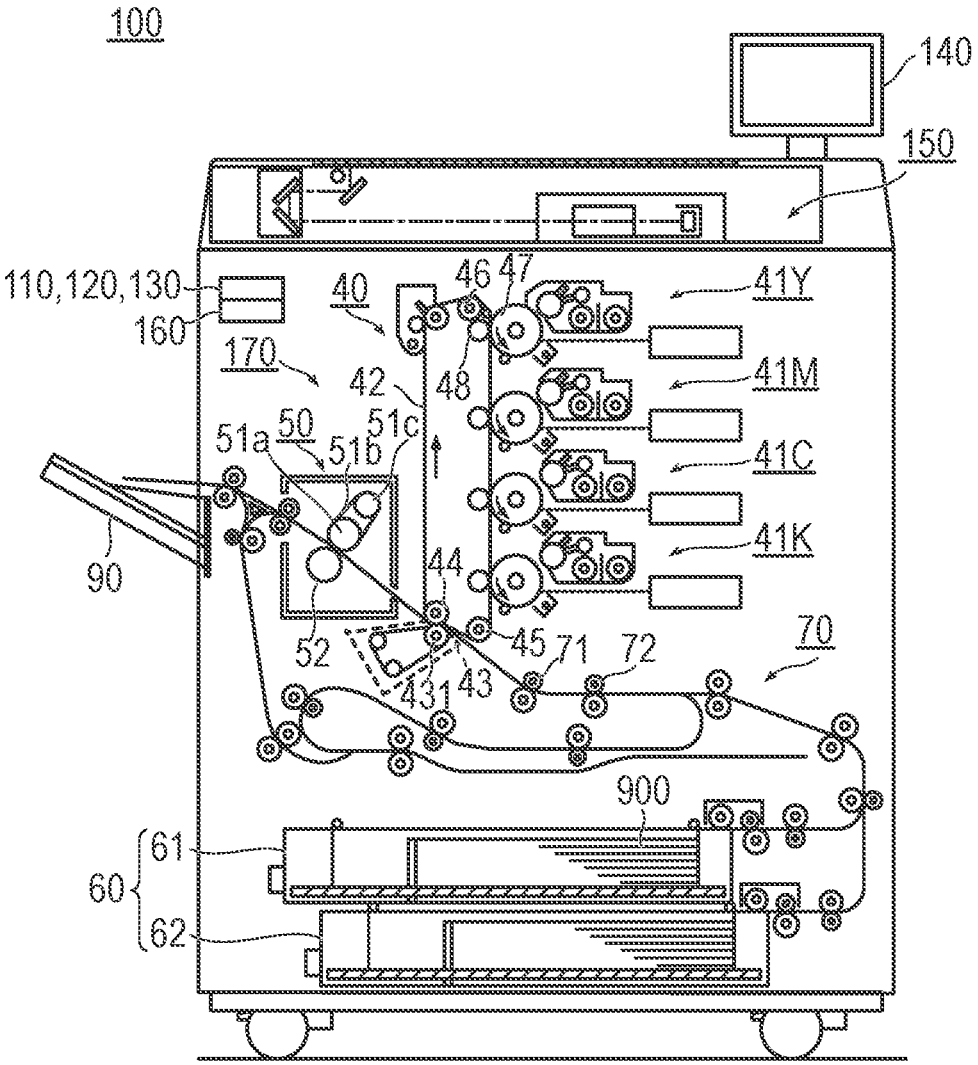
FIG. 1 is a schematic diagram illustrating a configuration of an image forming apparatus.

Hereinafter, one or more embodiments of the present invention will be described with reference to the drawings. However, the scope of the invention is not limited to the disclosed embodiments.

An image forming apparatus according to an embodiment of the present invention will be described below with reference to the drawings. Note that, in the drawings, the same elements are denoted by the same reference numerals, and redundant description is omitted. In addition, the dimensional ratios in the drawings are exaggerated for convenience of description, and may be different from the actual ratios.

First Embodiment

Figure 2:
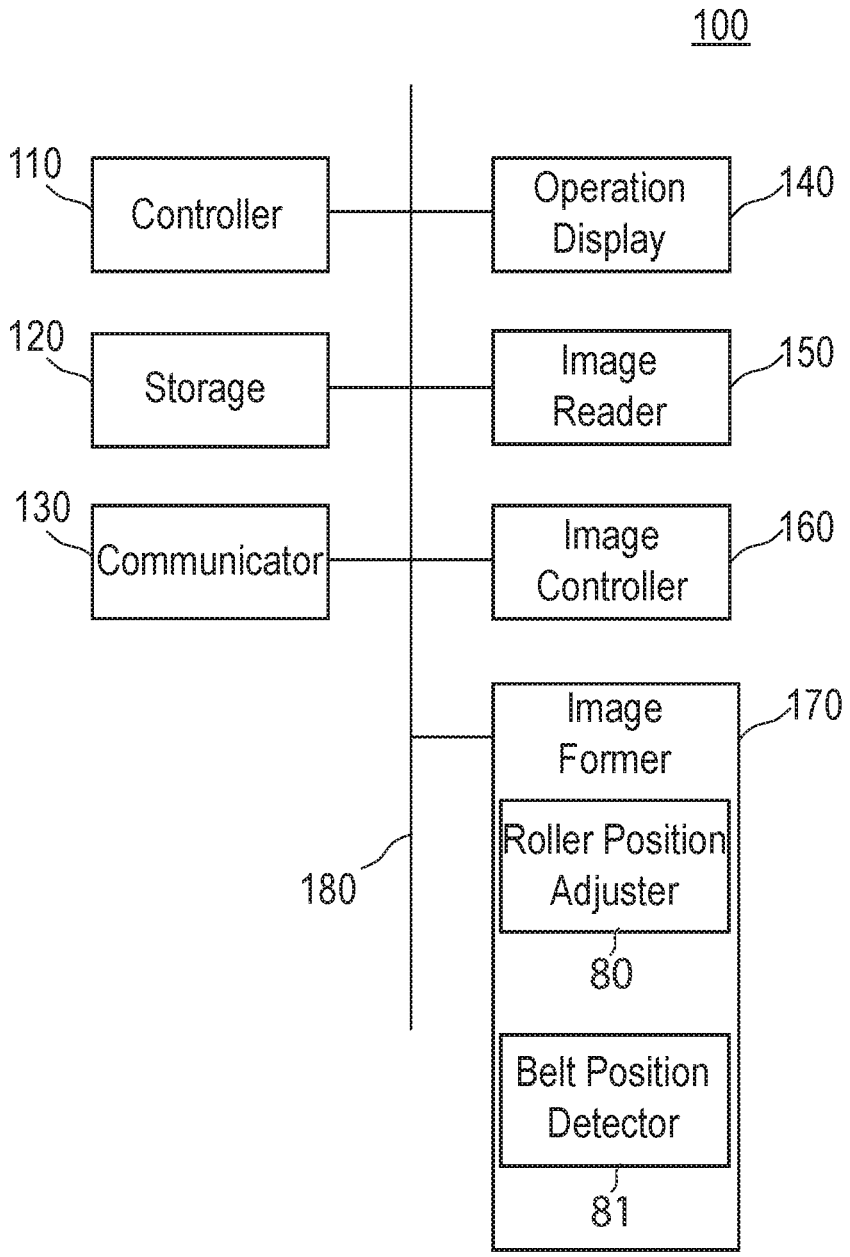
FIG. 2 is a block diagram illustrating the configuration of the image forming apparatus.

FIG. 1 is a schematic diagram illustrating a configuration of an image forming apparatus 100. FIG. 2 is a block diagram illustrating the configuration of the image forming apparatus 100. Here, in this embodiment, as an example, a secondary transfer roller 431, an opposing roller 44, and an intermediate transfer belt 42 in a secondary transferor are described as corresponding to two rollers that are separated (pressed/separated) via a belt, and the belt, respectively. However, the present invention is not limited to this, and may be applied to other roller and belt configurations as in the third to fifth embodiments described below.

The image forming apparatus 100 includes a controller 110, a storage 120, a communicator 130, an operation display 140, an image reader 150, an image controller 160, and an image former 170. These components are communicably connected to each other by a bus 180. The image forming apparatus 100 can be configured by, for example, an MFP (MultiFunction Peripheral).

The controller 110 includes a CPU (Central Processing Unit) and various memories, and controls the above units and performs various arithmetic processes according to a program. The controller 110 configures an arithmetic controller. Details of the operation of the controller 110 will be described later.

The storage 120 is configured by an SDD (Solid State Drive), an HDD (Hard Disc Drive) or the like, and stores various programs and various data.

The communicator 130 is an interface for performing communication between the image forming apparatus 100 and an external device. As the communicator 130, a network interface based on standards such as Ethernet (registered trademark), SATA, and IEEE1394 is used. Further, as the communicator 130, various local connection interfaces such as Bluetooth (registered trademark) and a wireless communication interface such as IEEE802.11 or the like are used. The communicator 130 configures an outputter.

The operation display 140 includes a touch panel, numeric keys, a start button, a stop button, and the like, and is used for displaying various pieces of information and inputting various instructions. The operation display 140 forms a display and an adjustment mechanism. Further, the operation display forms an outputter instead of the communicator 130.

The image reader 150 has a light source such as a fluorescent lamp and an imaging element such as a CCD (Charge Coupled Device) image sensor. The image reader 150 emits light from a light source to a document set at a predetermined reading position, photoelectrically converts the reflected light thereof with the imaging element, and generates image data from the electric signal thereof.

The image controller 160 performs layout processing and rasterization processing of print data included in a print job or the like received by the communicator 130, and generates bitmap image data.

The print job is a general term for a print command for the image forming apparatus 100, and includes print data and print settings. The print data is data of the document to be printed, and the print data may include various data such as image data, vector data, and text data, for example. Specifically, the print data may be PDL (Page Description Language) data, PDF (Portable Document Format) data, or TIFF (Tagged Image File Format) data. The print settings are settings related to image formation on a sheet 900, and include various settings such as the number of pages, the number of copies, the sheet type, selection of color or monochrome, and page layout.

The image former 170 includes an imaging device 40, a fixer 50, a sheet feeding unit 60, a sheet conveying unit 70, a roller position adjuster 80, and a belt position detector 81. The roller position adjuster 80 configures a driver. The belt position detector 81 configures a detector.

The image forming device 40 includes imaging units 41Y, 41M, 41C, and 41K corresponding to toners of colors of Y (yellow), M (magenta), C (cyan), and K (black). A toner image is formed on a photosensitive drum 47 by the imaging units 41Y, 41M, 41C, and 41K through charging, exposure, and development processes based on the image data. The exposure is performed by scanning the photosensitive drum 47 with a laser beam. When the photosensitive drum 47 and a primary transfer roller 48 are pressed via the intermediate transfer belt 42, and the intermediate transfer belt 42 travels to be rotated by the driving force of a driving roller 45, the toner images formed on the photosensitive drums 47 as an image carrier are superposed on the intermediate transfer belt 42 in order, thereby forming a color toner image. The intermediate transfer belt 42 travels in the sub-scanning direction (the direction of the straight arrow). When the secondary transfer roller 431 and the opposing roller 44 are pressed via the intermediate transfer belt 42, the color toner image formed on the intermediate transfer belt 42 is transferred onto the conveyed sheet 900. The width of the intermediate transfer belt 42 is, for example, 500 mm. The sliding speed of the intermediate transfer belt 42 is, for example, 500 mm/s.

A steering roller 46 changes the tension applied to the intermediate transfer belt 42 by adjusting the steering angle, and adjusts the position of the intermediate transfer belt 42 in the width direction with respect to the opposing roller 44 or the like that stretches the intermediate transfer belt 42. Accordingly, the position of the intermediate transfer belt 42 in the width direction with respect to the opposing roller 44 or the like is held substantially at the axial center of the opposing roller 44 or the like, thereby the intermediate transfer belt 42 is prevented from moving in the width direction and dropping from the opposing roller 44 or the like, or the like. The steering roller 46 configures a steering mechanism.

Figure 3B:
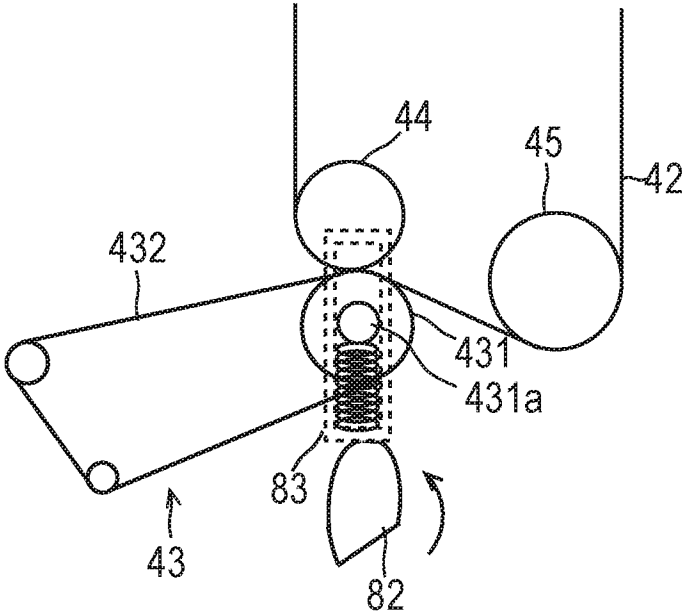
FIGS. 3A and 3B are explanatory diagrams illustrating a state in which a secondary transfer roller and an opposing roller are separated and pressed.
Figure 3A:
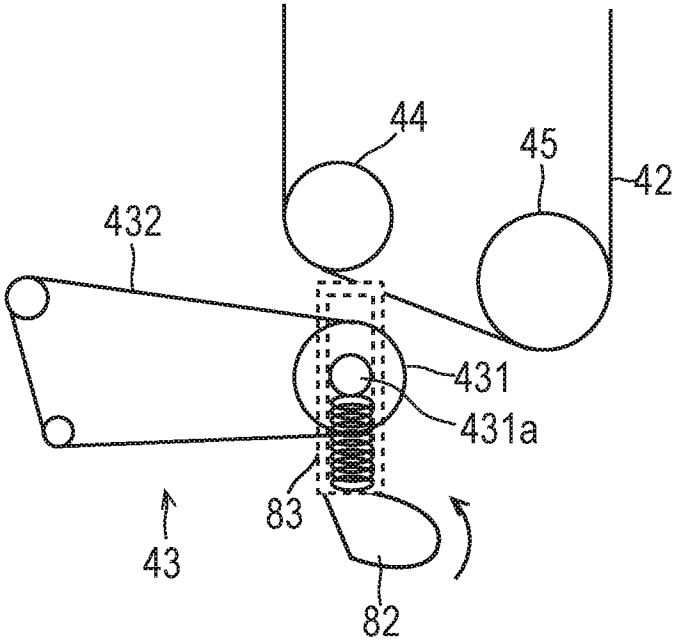

FIGS. 3A and 3B are explanatory diagrams illustrating a state where the secondary transfer roller 431 and the opposing roller 44 are separated and pressed. FIG. 3A illustrates a state where the secondary transfer roller 431 and the opposing roller 44 are separated. FIG. 3B illustrates a state where the secondary transfer roller 431 and the opposing roller 44 are pressed.

An endless belt 432 is stretched on the secondary transfer roller 431 together with a plurality of other rollers. The secondary transfer roller 431, and a plurality of other rollers stretching the belt 432 together with the secondary transfer roller 431, and the endless belt 432 are included in a housing that can be inserted into and removed from the image forming apparatus 100, thereby configuring a secondary transferor 43. The secondary transferor 43 becomes a component of the image forming apparatus 100 by being inserted into the image forming apparatus 100.

The secondary transfer roller 431, and the plurality of other rollers stretching the belt 432 together with the secondary transfer roller 431, and the endless belt 432 need not be included in the housing, thereby being a component installed as a part of the image forming apparatus 100. Further, in the secondary transferor 43, the endless belt 432 need not be used. In this case, the plurality of other rollers stretching the belt 432 together with the secondary transfer roller 431 are not required.

Figure 5:
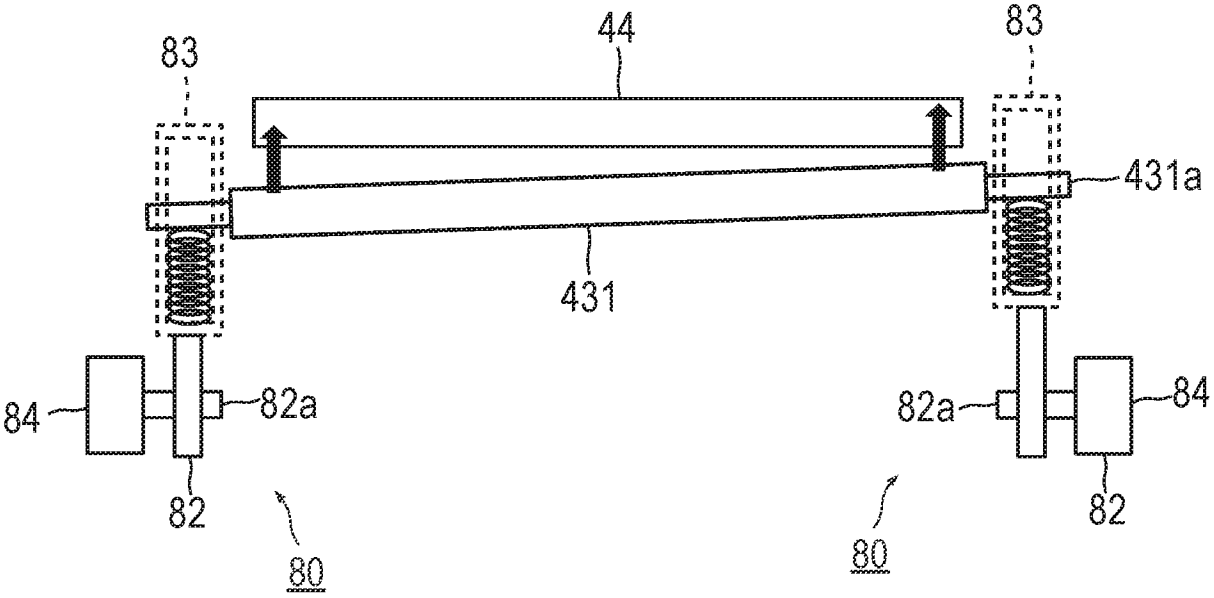
FIG. 5 is an explanatory diagram illustrating an operation of a roller position adjuster when parallelism between rollers is adjusted by the roller position adjuster.

The roller position adjuster 80 includes a cam 82, a spring-included sheet metal 83, and a drive motor 84 (see FIG. 5). The drive motor 84 configures a drive source. As the drive motor 84, for example, a stepping motor can be used. The cam 82 configures a conversion mechanism. The spring-included sheet metal 83 and the cam 82 are provided at positions corresponding to both ends of the secondary transfer roller 431, respectively. The roller position adjuster 80 adjusts the position of the secondary transfer roller 431 in the pressing direction (hereinafter, also simply referred to as "pressing direction") to the opposing roller 44. The roller position adjuster 80 adjusts the position of the secondary transfer roller 431 in the pressing direction so as to press the secondary transfer roller 431 with the opposing roller 44 and to adjust the parallelism (hereinafter, also simply referred to as "parallelism between rollers") of the secondary transfer roller 431 with respect to the opposing roller 44. The parallelism between the rollers is the difference in the distance between both ends of one roller and the other roller. The parallelism between the rollers may be, for example, the parallelism between the secondary transfer roller 431 and the opposing roller 44 when the secondary transfer roller 431 and the opposing roller 44 are pressed.

The secondary transfer roller 431 is pressed against the opposing roller 44 by being urged toward the opposing roller 44 by the roller position adjuster 80. Specifically, in a state where a shaft 431*a* of the secondary transfer roller 431 is in contact with the spring of the spring-included sheet metal 83, the bottom surface of the spring-included sheet metal 83 is pushed up by the cam 82 abutting on the bottom surface when the cam 82 rotates about a rotation shaft 82*a* attached to the eccentric position. As a result, the secondary transfer roller 431 is urged toward the opposing roller 44 together with the spring-included sheet metal 83, so that the secondary transfer roller 431 is pressed against the opposing roller 44. The secondary transfer roller 431 may be in contact with the spring of the spring-included sheet metal 83 via a bearing such as a ball bearing provided on the shaft 431*a* of the secondary transfer roller 431. The diameter of each of the secondary transfer roller 431 and the opposing roller 44 is, for example, 10 mm. The secondary transfer roller 431 and the opposing roller 44 are pressed such that the total load in the axial direction (hereinafter, also referred to as "roller axial direction") of the opposing roller 44 (or the secondary transfer roller 431) is, for example, between 70 N to 130 N. Hereinafter, a state in which the secondary transfer roller 431 and the opposing roller 44 are pressed is also simply referred to as "the time of pressing". A state in which the secondary transfer roller 431 and the opposing roller 44 are separated is also simply referred to as "the time of separation".

Figure 4A:
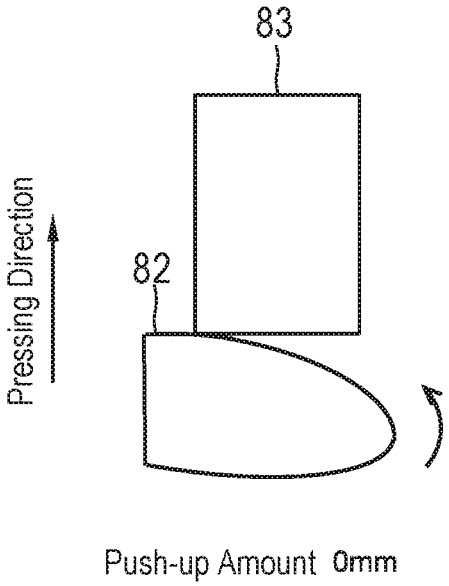
FIGS. 4A to 4C are explanatory diagrams illustrating examples of a push-up amount of a spring-included sheet metal by a cam due to rotation of the cam.
Figure 4B:
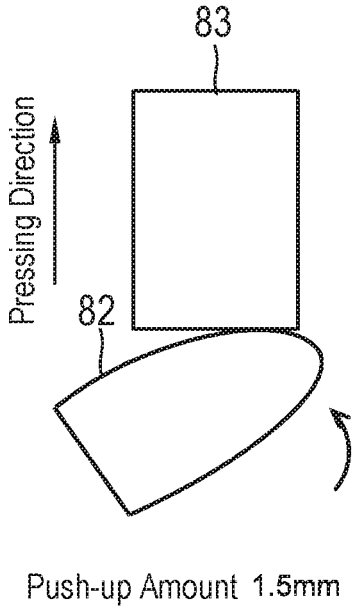
Figure 4C:
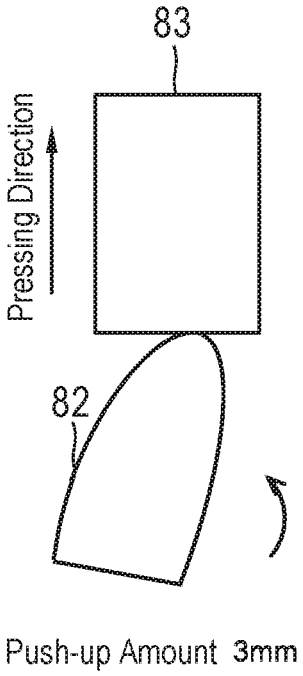

FIGS. 4A to 4C are explanatory diagrams illustrating an example of the push-up amount of the spring-included sheet metal 83 by the cam 82 due to the rotation of the cam 82. In FIGS. 4A to 4C, the straight arrows indicate the pressing direction. The arc arrows indicate the rotation direction of the cam 82.

FIGS. 4A to 4C illustrate the rotation state of the cam 82 and the position of the spring-included sheet metal 83 in the pressing direction due to the rotation of the cam 82 when the push-up amounts of the spring-included sheet metal 83 are 0 mm, 1.5 mm, and 3 mm, respectively.

FIG. 5 is an explanatory diagram illustrating the operation of the roller position adjuster 80 when the parallelism between the rollers is adjusted by the roller position adjuster 80.

As described above, the spring-included sheet metal 83 and the cam 82 are installed at positions corresponding to both ends of the secondary transfer roller 431, respectively. The drive motor 84 for rotating and driving the rotation shaft 82*a* of the cam 82 is provided corresponding to each cam 82. The roller position adjuster 80 adjusts the positions of the both ends of the secondary transfer roller 431 in the pressing direction (the direction of the arrow) by adjusting the push-up amount of each spring-included sheet metal 83 by the rotation of each cam 82. Thereby, the parallelism between the rollers is adjusted, and the gradient of the pressure at the time of pressing between the secondary transfer roller 431 and the opposing roller 44 (hereinafter, also referred to as "pressure gradient between the rollers") is adjusted.

The belt position detector 81 detects the position of the intermediate transfer belt 42 in the roller axial direction (hereinafter, also simply referred to as "the position of the intermediate transfer belt 42"). The position of the intermediate transfer belt 42 can be detected, for example, as the position of the end of the intermediate transfer belt 42 in the width direction (the axial direction of the opposing roller 44) in the axial direction of the opposing roller 44. The belt position detecting unit 81 is configured by, for example, a line sensor arranged along the width direction of the intermediate transfer belt 42, and the position (the end position or the like) of the intermediate transfer belt 42 is detected based on the light reflectance, which is measured by the line sensor, by the opposing roller 44 and the intermediate transfer belt 42.

Returning to FIG. 1, the description will be continued.

The fixer 50 includes a fixing roller 51*a*, a fixing belt 51*b*, a heating roller 51*c*, and a pressure roller 52. When the fixing roller 51*a* and the pressure roller 52 are pressed against each other via the endless fixing belt 51*b*, a fixing nip is formed between the fixing belt 51*b* and the pressure roller 52. The fixing belt 51*b* is stretched by the fixing roller 51*a* and the heating roller 51*c*. The fixing roller 51*a* and the pressure roller 52 are individually driven to rotate by drive motors (not illustrated). The fixing belt 51*b* and the heating roller 51*c* rotate following the rotation of the fixing roller 51*a*. The heating roller 51*c* and the pressure roller 52 are each heated to a predetermined temperature by a built-in heater. The fixing belt 51*b* is heated by the heating roller 51*c* to stretch. The sheet 900 conveyed to the fixer 50 is heated and pressed by the fixing nip such that the toner image is fixed (melt-fixed), and is conveyed by the rotation of the fixing belt 51*b* and the pressure roller 52.

The sheet 900 on which the toner image is fixed by the fixer 50 is discharged to the discharge tray 90 as a printed matter.

The sheet feeding unit 60 has a plurality of sheet feeding trays 61 and 62, and feeds out the sheets 900 stored in the sheet feeding trays 61 and 62 one by one to a downstream conveyance path.

The sheet conveying unit 70 has a plurality of conveying rollers for conveying the sheet 900, and conveys the sheet 900 between the image forming device 40, the fixer 50, and the sheet feeding unit 60. The plurality of conveying rollers include a registration roller 71 for correcting the gradient of the sheet 900 and a loop roller 72 for forming a predetermined amount of loop on the sheet 900.

The sheet conveying unit 70 discharges the sheet 900 on which the image is formed to the discharge tray 90.

The operation of the controller 110 will be described in detail.

Based on the detection result of the position of the intermediate transfer belt 42 detected by the belt position detecting unit 81, the controller 110 calculates the movement amount of the intermediate transfer belt 42 in the roller axial direction when the intermediate transfer belt 42 is made to travel for a predetermined time (hereinafter, also referred to as "belt movement amount"). The controller 110 calculates a first movement amount that is a belt movement amount in a state where the secondary transfer roller 431 and the opposing roller 44 are separated by the roller position adjuster 80. The controller 110 calculates a second movement amount that is a belt movement amount in a state where the secondary transfer roller 431 and the opposing roller 44 are pressed by the roller position adjuster 80. The predetermined time is, for example, one second, but is not limited thereto, and may be any time between 0.5 seconds and 10 seconds. Note that, for example, the movement amount of the intermediate transfer belt 42 in the roller axial direction when the intermediate transfer belt 42 travels for five seconds may be measured to calculate the movement amount of the intermediate transfer belt 42 in the roller axial direction per second and use the amount as a belt movement amount. In addition, the belt movement amount may be a movement amount of the intermediate transfer belt 42 in the roller axial direction when the intermediate transfer belt 42 travels a predetermined distance. The controller 110 further calculates a difference between the first movement amount and the second movement amount.

FIG. 6 is a diagram illustrating an effect on the belt movement amount by the pressure gradient at the time of pressing a target roller pair that can be separated via the belt and an effect on the belt movement amount by rollers other than the target roller pair about each of the time of separation and the time of pressing the target roller pair. The target roller pair corresponds to the secondary transfer roller 431 and the opposing roller 44. The rollers other than the target roller pair correspond to the driving roller 45 and the like that stretches the intermediate transfer belt 42. The belt movement amount at the time of separation of the target roller pair corresponds to the first movement amount. The belt movement amount at the time of pressing the target roller pair corresponds to the second movement amount.

As illustrated in FIG. 6, when the target roller pair is separated, the rollers other than the target roller pair affect the belt movement amount, and the pressure gradient at the time of pressing the target roller pair does not affect the belt movement amount. The reason why the pressure gradient at the time of pressing the target roller pair does not affect the belt movement amount is that no pressure is generated between the rollers of the target roller pair at the time of separation of the target roller pair. When the target roller pair is pressed, the rollers other than the target roller pair affect the belt movement amount, and the pressure gradient at the time of pressing the target roller pair also affects the belt movement amount. The effect of the rollers other than the target roller pair on the belt movement amount is made similarly at both of the time of separation and the time of pressing of the target roller pair. Therefore, by calculating the difference between the belt movement amount (first movement amount) at the time of separation of the target roller pair and the belt movement amount (second movement amount) at the time of pressing the target roller pair, the pressure gradient at the time of pressing the target roller pair can be evaluated with high accuracy.

The controller 110 calculates the parallelism between the rollers and the pressure gradient between the rollers based on the first movement amount and the second movement amount.

FIG. 7 is a diagram illustrating a relation between the difference between the first movement amount and the second movement amount, and the parallelism between the rollers and the pressure gradient between the rollers. These relations can be obtained, for example, by experiment. The parallelism between the rollers and the pressure gradient between the rollers configure the adjustment index. In the example of FIG. 7, a value obtained by subtracting the first movement amount from the second movement amount is calculated as a difference between the first movement amount and the second movement amount. The parallelism between the rollers is calculated as the positional deviation of the roller shaft in the pressing direction (the difference between the shaft of the secondary transfer roller 431 and the shaft of the opposing roller 44) at both ends of the shaft of the secondary transfer roller 431. Specifically, the parallelism between the rollers is calculated as a value obtained by subtracting the distance from the shaft of the opposing roller 44 at the front end of the secondary transfer roller 431 from the distance from the shaft of the opposing roller 44 at the rear end. Here, the front end of the secondary transfer roller 431 is, for example, the end closer to the insertion opening of the secondary transferor 43 inserted into the image forming apparatus 100, and the rear end of the secondary transfer roller 431 is the end farthest from the insertion opening. The pressure gradient between the rollers is calculated as the difference of the pressure on the secondary transfer roller 431 between both ends of the secondary transfer roller 431. Specifically, the pressure gradient between the rollers is calculated as the value obtained by subtracting the pressure applied to the secondary transfer roller 431 by the opposing roller 44 at the rear end of the secondary transfer roller 431 from the pressure applied to the secondary transfer roller 431 by the opposing roller 44 at the front end.

As illustrated in FIG. 7, for example, when the difference between the first movement amount and the second movement amount is −2 mm, the positional deviation of the roller shaft is +0.5 mm, and the pressure gradient between the rollers is +10 N. The minus sign of the value of the difference between the first movement amount and the second movement amount indicates that the intermediate transfer belt 42 moves to the rear side of the secondary transfer roller 431. The positive sign of the value of the positional deviation of the roller shaft indicates that the distance from the shaft of the opposing roller 44 at the front end of the secondary transfer roller 431 is shorter than the distance from the shaft of the opposing roller 44 at the rear end. The positive sign of the value of the pressure gradient between the rollers indicates that the pressure on the secondary transfer roller 431 at the front end of the secondary transfer roller 431 is larger than the pressure on the secondary transfer roller 431 at the rear end.

As described above, the difference between the first movement amount and the second movement amount reflects the pressure gradient between the rollers at the time of pressing with high accuracy. Further, the pressure gradient between the rollers at the time of pressing is caused by the parallelism between the rollers. Therefore, the parallelism between the rollers and the pressure gradient between the rollers can be calculated based on the difference between the first movement amount and the second movement amount. For example, the relations between the difference between the first movement amount and the second movement amount, and the parallelism between the rollers and the pressure gradient between the rollers are each measured by experiments or the like, and an approximate expression indicating the relations is obtained in advance. Then, using the relational expression, the parallelism between the rollers and the pressure gradient between the rollers can be calculated from the measurement result of the difference between the first movement amount and the second movement amount.

The controller 110 calculates the first movement amount, the second movement amount, and the difference between the first movement amount and the second movement amount at at least one timing of the time of replacement of members configuring the image forming apparatus 100, the time of shipment of the image forming apparatus 100, and the time of image formation by the image former 170. This is because the positional deviation of the roller shaft and the pressure gradient between the rollers may occur due to the machine tolerance between the secondary transfer roller 431 and the opposing roller 44, for example, at the time of replacement of members such as the secondary transferor 43 configuring the image forming apparatus 100 or the like. The controller 110 calculates the first movement amount, the second movement amount, and the difference between the first movement amount and the second movement amount at an arbitrary timing such as a timing at which the instruction input on the operation display 140 or the like from the user is received. The controller 110 calculates the first movement amount, the second movement amount, and the difference between the first movement amount and the second movement amount at timing when a change in at least one of the internal temperature and the external temperature of the image forming apparatus 100 becomes a predetermined amount or more. The internal temperature and the external temperature of the image forming apparatus 100 can be obtained by, for example, an installed internal temperature sensor and an external temperature sensor (both not illustrated), respectively. This is because expansion and contraction of the members of the image forming apparatus 100 due to changes in the internal temperature and the external temperature affect the pressure gradient between the rollers. The relation between the internal temperature and the like and the change in the difference between the first movement amount and the second movement amount is obtained from experiments and the like, thereby the predetermined amount can be set to an appropriate value from the viewpoint of the quality of the printed matter and the occurrence rate of jams in the conveyance of the sheet 900 and the like. The predetermined amount may be set as, for example, 10° C.

The controller 110 calculates the first movement amount and the second movement amount based on the detection result by the belt position detecting unit 81 in a state where at least one of the first movement amount and the second movement amount is adjusted to be zero by the steering roller 46.

The controller 110 causes the operation display 140 to display the calculation results of the first movement amount and the second movement amount, the difference between the first movement amount and the second movement amount, the parallelism between the rollers, and the pressure gradient between the rollers.

The controller 110 causes the roller position adjuster 80 to adjust the position of both ends or one end of the secondary transfer roller 431 in the pressing direction to the opposing roller 44 based on any one of the first movement amount and the second movement amount, the difference between the first movement amount and the second movement amount, the parallelism between the rollers, and the pressure gradient between the rollers such that the secondary transfer roller 431 and the opposing roller 44 are in parallel. That is, the controller 110 adjusts the position of both ends or one end of the secondary transfer roller 431 in the pressing direction to the opposing roller 44 by adjusting the rotation angle of the cam 82 (see FIG. 5) of the roller position adjuster 80, such that the difference between the first movement amount and the second movement amount becomes zero.

The rotation angle of the cam 82 of the roller position adjuster 80 can be adjusted according to the adjustment amount according to a user instruction input to the operation display 140. That is, the position of both ends or one end of the secondary transfer roller 431 in the pressing direction to the opposing roller 44 can be adjusted manually. In this case, the controller 110 outputs at least one of the first movement amount and the second movement amount, the difference between the first movement amount and the second movement amount, the parallelism between the rollers, and the pressure gradient between the rollers to the user by display on the operation display 140 or transmission from the communicator 130 to the terminal of the user or the like. Accordingly, the user adjusts the position of both ends or one end of the secondary transfer roller 431 in the pressing direction to the opposing roller 44 by adjusting the rotation angle and the like of the cam 82 based on the output information, such that the secondary transfer roller 431 and the opposing roller 44 are in parallel. Note that the rotation angle of the cam 82 of the roller position adjuster 80 may be adjusted by the adjustment amount by the force of the user. For example, a knob (not illustrated) as an adjustment mechanism may be provided on the rotation shaft 82*a* of the cam 82, and the rotation angle of the cam 82 may be adjusted by rotating the knob by the force of the user.

The operation of the image forming apparatus 100 will be described.

Figure 8:
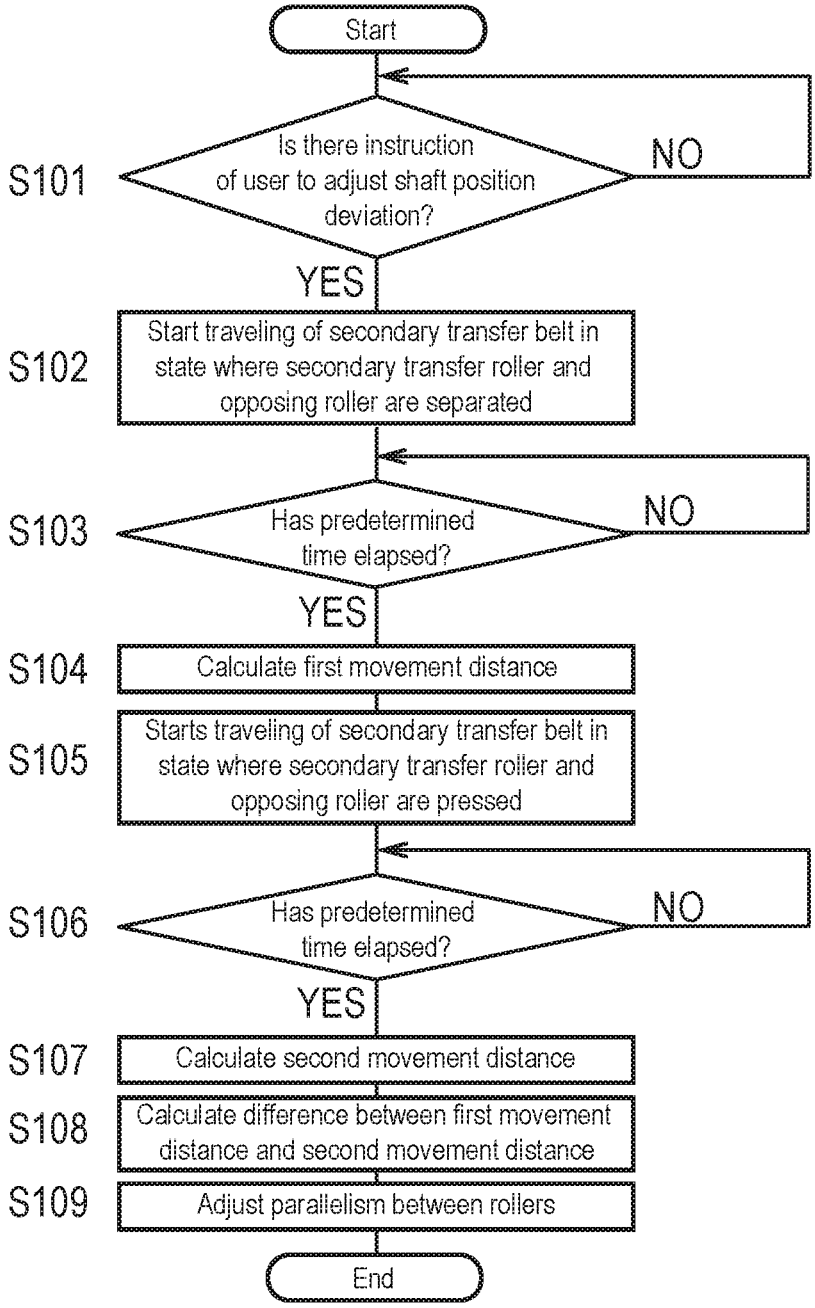
FIG. 8 is a flowchart illustrating an operation of the image forming apparatus.

FIG. 8 is a flowchart illustrating the operation of the image forming apparatus 100. This flowchart can be executed by the controller 110 according to the program stored in the storage 120.

The controller 110 determines whether or not there is the input of the instruction by the user to adjust the shaft position deviation in the operation display 140 (S101).

When it is determined that there is not the input of the instruction by the user to adjust the shaft position deviation in the operation display 140 (S101: NO), the controller 110 repeatedly executes Step S101.

When it is determined that there is the input of the instruction by the user to adjust the shaft position deviation in the operation display 140 (S101: YES), the controller 110 starts the traveling of the intermediate transfer belt 42 in a state where the secondary transfer roller 431 and the opposing roller 44 are separated (S102).

The controller 101 determines whether or not a predetermined time has elapsed since the start of the traveling of the intermediate transfer belt 42 by using a timer (not illustrated) built in the image forming apparatus 100 (S103).

When it is not determined that the predetermined time has elapsed since the start of the traveling of the intermediate transfer belt 42 (S103: NO), the controller 101 repeatedly executes Step S103.

When it is determined that the predetermined time has elapsed since the start of the traveling of the intermediate transfer belt 42 (S103: YES), the controller 101 calculates the belt movement amount in the predetermined time as the first movement amount based on the detection result of the position of the intermediate transfer belt 42 by the belt position detecting unit 81 (S104).

Thereafter, the controller 101 starts the traveling of the intermediate transfer belt 42 in a state where the secondary transfer roller 431 and the opposing roller 44 are pressed (S105).

The controller 101 determines whether or not a predetermined time has elapsed since the start of the traveling of the intermediate transfer belt 42 by using the timer (S106).

When it is not determined that the predetermined time has elapsed since the start of the traveling of the intermediate transfer belt 42 (S106: NO), the controller 101 repeatedly executes Step S106.

When it is determined that the predetermined time has elapsed since the start of the traveling of the intermediate transfer belt 42 (S106: YES), the controller 101 calculates the belt movement amount in the predetermined time as the second movement amount based on the detection result of the position of the intermediate transfer belt 42 by the belt position detecting unit 81 (S107).

The controller 101 calculates the difference between the first movement amount and the second movement amount (S108).

The controller 101 adjusts the parallelism between the rollers by the roller position adjuster 80, such that the difference between the first movement amount and the second movement amount becomes zero (S109).

Second Embodiment

A second embodiment of the present invention will be described. This embodiment differs from the first embodiment in the following points. In the first embodiment, the driving forces of the two drive motors 84 are converted into driving forces for changing the positions of both ends of the shaft of the secondary transfer roller 431 by the two cams 82, respectively. On the other hand, in this embodiment, the driving force of one drive motor 84 is converted to the driving forces of changing the positions of both ends of the shaft of the secondary transfer roller 431 by two cams 82 which have a common rotation shaft and of which the shapes are different when viewed from the direction of the rotation shaft. In other points, this embodiment is the same as the first embodiment, and redundant description is omitted.

Figure 9:
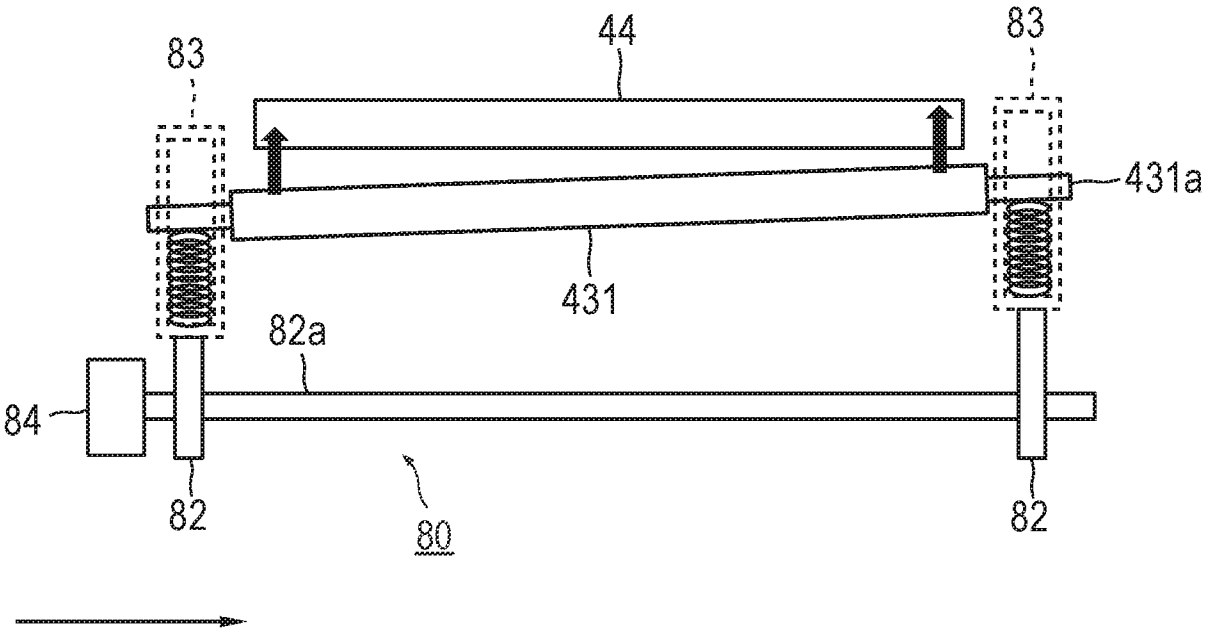
FIG. 9 is an explanatory diagram illustrating the operation of the roller position adjuster when the parallelism between rollers is adjusted by the roller position adjuster.

FIG. 9 is an explanatory diagram illustrating the operation of the roller position adjuster 80 when the parallelism between the rollers is adjusted by the roller position adjuster 80.

The spring-included sheet metal 83 and the cam 82 are provided at positions corresponding to both ends of the secondary transfer roller 431, respectively. The common rotation shaft 82*a* of the two cams 82 is rotationally driven by one drive motor 84. The two cams 82 have different shapes when viewed from the direction of the rotation shaft 82*a*, as indicated by thin arrows. Accordingly, the roller position adjuster 80 adjusts the positions of the both ends of the secondary transfer roller 431 in the pressing direction (the direction of the thick arrow) with different adjustment amounts of the push-up amount of each spring-included sheet metal 83 by the rotation of each cam 82. That is, the parallelism between the rollers and the pressure gradient between the rollers are adjusted by the rotation driving of the two cams 82 by one drive motor 84.

FIGS. 10A to 10D are explanatory diagrams illustrating examples of the shape of the two cams 82 when viewed from the direction of the rotation shaft 82*a*. In FIGS. 10A to 10D, the cam 82(F) arranged at a position corresponding to the front side of the secondary transfer roller 431 and the cam 82(R) arranged at a position corresponding to the rear side are illustrated to be distinguished by solid lines and broken lines, respectively. Further, the points where the two cams 82(F) and 82(R) are in contact with the spring-included sheet metal 83 are indicated by a solid circle 83*a*(F) and a broken circle 83*a*(R), respectively.

Figure 10A:
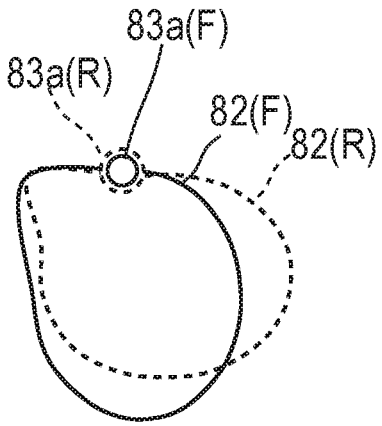
FIGS. 10A to 10D are explanatory diagrams illustrating examples of shapes of two cams when viewed from a direction of a rotation shaft.
Figure 10B:
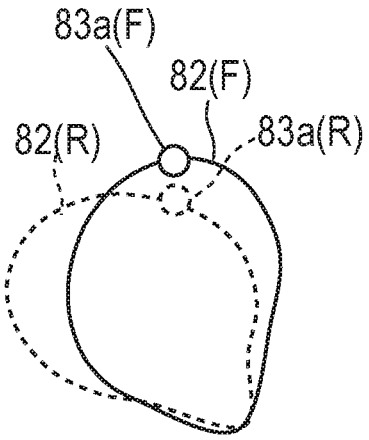
Figure 10C:
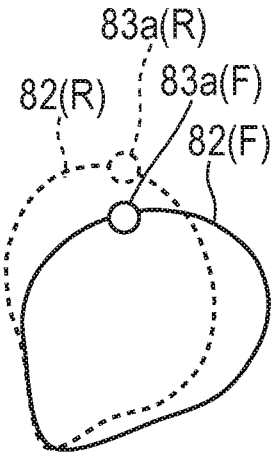
Figure 10D:
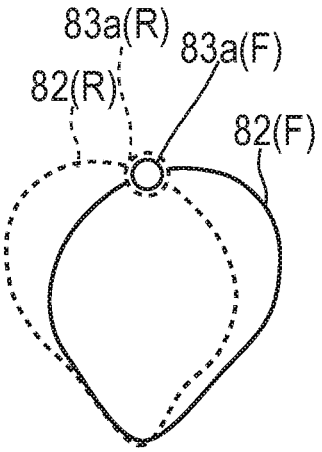

As illustrated in FIGS. 10A to 10D, in one cam 82(F) and the other cam 82(R) of the two cams 82, the shapes of the two cams 82 when viewed from the direction of the rotation shaft 82*a* are different. Accordingly, by rotating the two cams 82(F) and 82(R) about the common rotation shaft 82*a*, at the rotation angles of FIGS. 10B and 10C, the push-up amounts by which the cams 82(F) and 82(R) push up the spring-included sheet metal 83 are different from each other. That is, the push-up amount of each spring-included sheet metal 83 is adjusted by different adjustment amounts by one drive motor 84. At the rotation angles of FIGS. 10A and 10D, the push-up amounts by which the cams 82(F) and 82(R) push up the spring-included sheet metal 83 are the same. However, the push-up amount of the spring-included sheet metal 83 in FIG. 10A is different from the push-up amount of the spring-included sheet metal 83 in FIG. 10D. Thus, by changing the rotation angle in FIG. 10A into the rotation angle in FIG. 10D, the pressure between the rollers is increased without adjusting the parallelism between the rollers and the pressure gradient between the rollers.

Third Embodiment

A third embodiment of the present invention will be described. This embodiment differs from the first embodiment in the following points. In the first embodiment, the parallelism between the secondary transfer roller 431 and the opposing roller 44 is adjusted. On the other hand, in this embodiment, the parallelism between the fixing roller 51*a* of the fixer 50 and the pressure roller 52 is adjusted. In other points, this embodiment is the same as the first embodiment, and redundant description is omitted.

The fixing roller 51*a* and the pressure roller 52 are pressed and separated via the fixing belt 51*b*. Therefore, similarly to the first embodiment, the first movement amount can be calculated when the fixing belt 51*b* is made to travel for a predetermined time in a state where the fixing roller 51*a* and the pressure roller 52 are separated from each other. The second movement amount can be calculated when the fixing belt 51*b* is made to travel for the predetermined time in a state where the fixing roller 51*a* and the pressure roller 52 are pressed. Then, the parallelism between the fixing roller 51*a* and the pressure roller 52 of the fixer 50 can be adjusted based on the first movement amount and the second movement amount.

In this embodiment, for example, the belt position detector 81 is configured by a line sensor arranged along the width direction of the fixing belt 51*b*, and the position of the fixing belt 51*b* in the width direction with respect to the fixing roller 51*a* is detected based on the light reflectance, which is measured by the line sensor, by the fixing roller 51*a* and the fixing belt 51*b*. The first movement amount and the second movement amount are calculated based on the detection result of the belt position detector 81.

Fourth Embodiment

A fourth embodiment of the present invention will be described. This embodiment differs from the first embodiment in the following points. In the first embodiment, the parallelism between the secondary transfer roller 431 and the opposing roller 44 is adjusted. On the other hand, in this embodiment, the parallelism between the photosensitive drum 47 as an image carrier and the primary transfer roller 48 is adjusted. In other points, this embodiment is the same as the first embodiment, and redundant description is omitted.

The photosensitive drum 47 and the primary transfer roller 48 are pressed and separated via the intermediate transfer belt 42. Therefore, similarly to the first embodiment, when the intermediate transfer belt 42 is made to travel for the predetermined time in a state where the photosensitive drum 47 and the primary transfer roller 48 are separated from each other, the first movement amount can be calculated based on the detection result of the belt position detector 81. In addition, when the intermediate transfer belt 42 is made to travel for the predetermined time in a state where the photosensitive drum 47 and the primary transfer roller 48 are pressed, the second movement amount can be calculated based on the detection result of the belt position detector 81. Then, the parallelism between the photosensitive drum 47 and the primary transfer roller 48 can be adjusted based on the first movement amount and the second movement amount.

Fifth Embodiment

A fifth embodiment of the present invention will be described. This embodiment differs from the first embodiment in the following points. The image forming apparatus 100 of the first embodiment forms the image on the sheet 900 by an intermediate transfer system (tandem system). On the other hand, this embodiment is the image forming apparatus 100 using a direct transfer system of directly transferring an image from the photosensitive drum 47 as an image carrier to the sheet 900. In other points, this embodiment is the same as the first embodiment, and redundant description is omitted.

Figure 11:
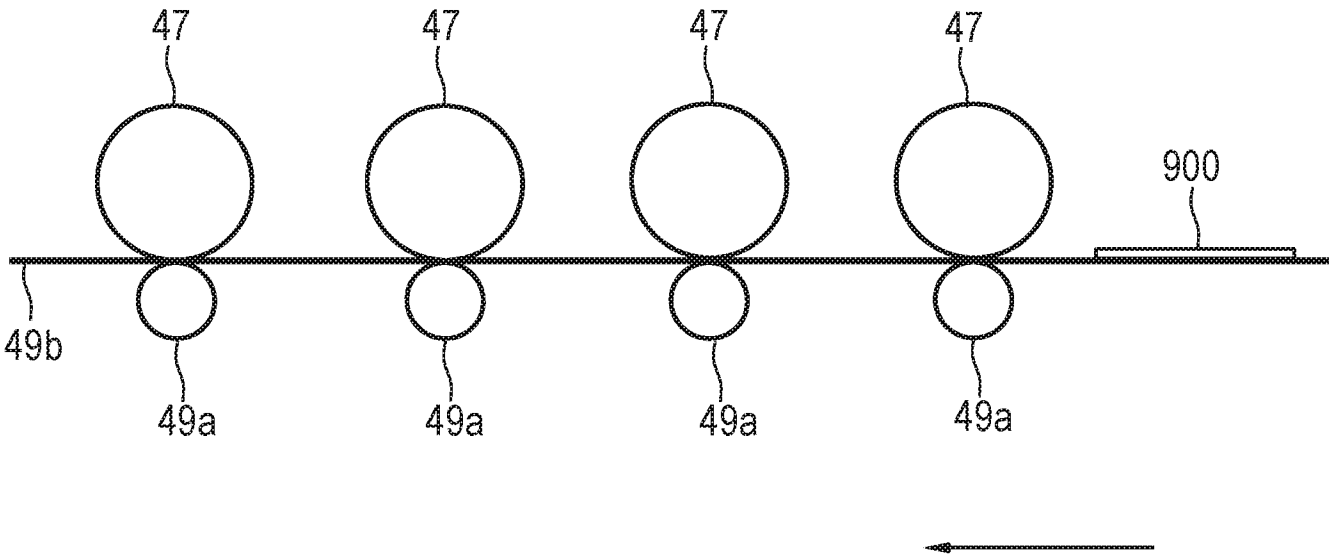
FIG. 11 is an explanatory diagram illustrating a configuration of a photosensitive drum and a transfer roller of an imaging device of the image forming apparatus.

FIG. 11 is an explanatory diagram illustrating the configuration of the photosensitive drum 47 and a transfer roller 49*a* of the image forming device 40 of the image forming apparatus 100. FIG. 11 illustrates a state where the photosensitive drum 47 and the transfer roller 49*a* are pressed via a transfer belt 49*b*. Four combinations of the pressed photosensitive drum 47 and the transfer roller 49*a* are shown, and the combinations are provided to transfer the toner image with the toner of each color of Y, M, C, and K to the sheet 900. The toner image with each color is formed at a position on each photosensitive drum 47 corresponding to the position of each photosensitive drum 47 in the sub-scanning direction indicated by an arrow. The color toner image is formed on the sheet 900 by forming the toner image of each color on the sheet 900 in an overlapping manner.

The photosensitive drum 47 and the transfer roller 49*a* are pressed and separated from each other via the transfer belt 49*b*. Therefore, similarly to the first embodiment, the first movement amount can be calculated when the transfer belt 49*b* is made to travel for a predetermined time in a state where the photosensitive drum 47 and the transfer roller 49*a* are separated from each other. The second movement amount can be calculated when the transfer belt 49*b* is made to travel for the predetermined time in a state where the photosensitive drum 47 and the transfer roller 49*a* are pressed. Then, the parallelism between the photosensitive drum 47 and the transfer roller 49*a* can be adjusted based on the first movement amount and the second movement amount.

In this embodiment, the belt position detector 81 is configured by, for example, a line sensor arranged along the width direction of the transfer belt 49*b*, and the position of the transfer belt 49*b* in the width direction with respect to the transfer roller 49*a* is detected based on the light reflectance, which is measured by the line sensor, by the transfer roller 49*a* and the transfer belt 49*b*. The first movement amount and the second movement amount are calculated based on the detection result of the belt position detector 81.

The embodiment described above has the following effects.

The first movement amount of the belt in the axial direction of the roller when the belt is made to travel for the predetermined time in the state where the roller pair that can be pressed and separated via the belt is separated and the second movement amount of the belt in the axial direction of the roller when the belt is made to travel for the predetermined time in the pressed state are calculated. Accordingly, the axial pressure gradient between the rollers can be reduced easily and accurately based on the calculation result.

Further, the difference between the first movement amount and the second movement amount is calculated. Accordingly, it is possible to easily reduce the pressure gradient between the rollers in the axial direction by adjusting the parallelism of the roller pair.

Further, at least one of the parallelism between the two rollers and the gradient of the pressure with respect to the axial direction of two rollers is calculated based on the first movement amount and the second movement amount. Accordingly, it is possible to more easily reduce the pressure gradient between the rollers in the axial direction by adjusting the parallelism of the roller pair.

Further, the first movement amount and the second movement amount are calculated at at least one timing of the time of replacement of members configuring the image forming apparatus, the time of shipment of the image forming apparatus, and the time of starting the image forming operation. Accordingly, the pressure gradient between the rollers in the axial direction can be reduced effectively.

Further, the first movement amount and the second movement amount are calculated at timing when a change in at least one of the internal temperature and the external temperature of the image forming apparatus becomes a predetermined amount or more. Accordingly, the pressure gradient between the rollers in the axial direction can be reduced more effectively.

Further, the first movement amount and the second movement amount are calculated at an arbitrary timing. Accordingly, it is possible to flexibly reduce the pressure gradient between the rollers in the axial direction at a desired timing according to the request of the user.

Further, the first movement amount and a second movement amount are calculated in a state where any one of the first movement amount and the second movement amount is adjusted to be zero by the steering mechanism which adjusts the movement of the position of the belt at the time of the traveling of the belt. Accordingly, it is possible to reduce the pressure gradient between the rollers in the axial direction with higher accuracy.

Further, the two rollers are set as at least one of the roller pair including the image carrier of the primary transferor for transferring the toner from the image carrier onto the belt, the roller pair of the secondary transferor for transferring the toner on the belt to the recording medium, and the roller pair of the fixer for fixing the toner on the recording medium. Accordingly, it is possible to effectively improve the quality of the printed matter and prevent the conveyance failure of the sheet.

Further, the two rollers are the roller pair including the image carrier of the direct transfer type transferor that transfers the toner from the image carrier to the recording medium. Accordingly, it is possible to effectively improve the quality of the printed matter and prevent the conveyance failure of the sheet.

Further, the adjuster is provided which can adjust the parallelism of each shaft of the two rollers by adjusting the position of at least one of the two rollers based on the first movement amount and the second movement amount or the adjustment index calculated from the first movement amount and the second movement amount. Accordingly, it is possible to flexibly reduce the pressure gradient between the rollers in the axial direction by hand, software, or hardware.

Further, the outputter is provided which outputs at least one of the first movement amount and the second movement amount, and the adjustment index to a user. The adjuster includes the adjustment mechanism that adjusts the position of at least one of two rollers according to the instruction input by the user or the adjustment amount by the force of the user and adjusts the parallelism of each shaft of the two rollers by the adjustment mechanism. Accordingly, the user manually adjusts the position of at least one of the two rollers with reference to the output results of the first movement amount, the second movement amount, and the like, so that the pressure gradient between the rollers in the axial direction can be accurately adjusted.

Further, the adjuster adjusts the parallelism of the shafts of the two rollers, by adjusting the position of at least one of the two rollers, based on the first movement amount and the second movement amount, or the adjustment index by two drive sources respectively arranged on both sides of at least one shaft of the two rollers and the conversion mechanism that converts driving forces of the two drive sources into respective driving forces of changing positions of both ends of the shaft. Accordingly, the pressure gradient between the rollers in the axial direction can be reduced with high accuracy without requiring any operation by the user.

Further, the adjuster includes one drive source, the first conversion mechanism that converts the driving force of the drive source into the driving force of changing the position of one end of the shaft of one of the two rollers, and the second conversion mechanism that converts the driving force of the drive source into the driving force of changing the position of another end of the shaft. The first conversion mechanism is a first cam that rotates about the rotation shaft by the driving force of the drive source so as to convert the driving force of the drive source into the driving force of changing the position of the one end of the shaft. The second conversion mechanism is the second cam that rotates about the rotation shaft together with the first cam by the driving force of the drive source so as to convert the driving force of the drive source into the driving force of changing the position of the other end of the shaft. Shapes of the first cam and the second cam when viewed from the direction of the rotation shaft are different. Accordingly, the pressure gradient between the rollers in the axial direction can be reduced with high accuracy without requiring any operation by the user and with a smaller number of members.

The display is further provided which displays the calculation result obtained by the arithmetic controller. Thereby, the parallelism of the roller pair or the like can be confirmed.

The invention is not limited to the embodiments described above.

For example, in the embodiment, the sheet has been described as the example of the storage medium, but the recording medium is not limited to the sheet, and may be a resin film or the like.

Further, some or all of the processing executed by the program in the embodiment may be executed by replacing hardware such as a circuit.

Although embodiments of the present invention have been described and illustrated in detail, the disclosed embodiments are made for purpose of illustration and example only and not limitation. The scope of the present invention should be interpreted by terms of the appended claims

What is claimed is:

1. An image forming apparatus comprising:

a driver that presses and separates two rollers via a belt;

a detector that detects a position of said belt in an axial direction of one roller of said two rollers; and a hardware processor that calculates, based on a detection result by said detector, a first movement amount of the position of said belt in said axial direction at a time of traveling of said belt in a state where said two rollers are separated and a second movement amount of the position of said belt in said axial direction at a time of traveling of said belt in a state where said two rollers are pressed;

wherein said hardware processor further calculates at least one of parallelism between said two rollers and a gradient of a pressure in said axial direction of said two rollers based on said first movement amount and said second movement amount.

2. The image forming apparatus according to claim 1, wherein said hardware processor further calculates a difference between said first movement amount and said second movement amount.

3. The image forming apparatus according to claim 1, wherein said hardware processor calculates said first movement amount and said second movement amount at least one timing of the time of replacement of members configuring said image forming apparatus, the time of shipment of said image forming apparatus, and the time of starting the image forming operation.

4. The image forming apparatus according to claim 1, wherein said hardware processor calculates said first movement amount and said second movement amount at a timing when a change in at least one of an internal temperature and an external temperature of said image forming apparatus becomes a predetermined amount or more.

5. The image forming apparatus according to claim 1, wherein said hardware processor calculates said first movement amount and said second movement amount at an arbitrary timing.

6. The image forming apparatus according to claim 1, the apparatus further comprising:

a steering mechanism that adjusts a movement of the position of said belt at the time of traveling of said belt, wherein said hardware processor calculates said first movement amount and said second movement amount in a state where any one of said first movement amount and said second movement amount is adjusted to be zero by the steering mechanism.

7. The image forming apparatus according to claim 1, wherein said two rollers are at least one of a roller pair including an image carrier of a primary transferor for transferring a toner from said image carrier onto said belt, a roller pair of a secondary transferor for transferring the toner on said belt to a recording medium, and a roller pair of a fixer for fixing the toner on the recording medium.

8. The image forming apparatus according to claim 1, wherein said two rollers are a roller pair including an image carrier of a direct transfer type transferor that transfers a toner from said image carrier to a recording medium.

9. The image forming apparatus according to claim 1, the apparatus further comprising:

an adjuster that is capable of adjusting parallelism of each shaft of said two rollers by adjusting a position of at least one of said two rollers based on said first movement amount and said second movement amount or an adjustment index calculated from said first movement amount and said second movement amount.

10. The image forming apparatus according to claim 9, the apparatus further comprising:

an outputter that outputs at least one of said first movement amount and said second movement amount, and said adjustment index to a user, wherein said adjuster includes an adjustment mechanism that adjusts a position of at least one of said two rollers according to an instruction input by a user or an adjustment amount by a force of the user and adjusts parallelism of each shaft of said two rollers by said adjustment mechanism.

11. The image forming apparatus according to claim 9, wherein said adjuster adjusts parallelism of the shafts of said two rollers, by adjusting the position of at least one of said two rollers, based on said first movement amount and said second movement amount, or said adjustment index by two drive sources respectively arranged on both sides of at least one shaft of said two rollers and a conversion mechanism that converts driving forces of said two drive sources into respective driving forces of changing positions of both ends of said shaft.

12. The image forming apparatus according to claim 9, wherein said adjuster includes one drive source, a first conversion mechanism that converts a driving force of said drive source into a driving force of changing a position of one end of a shaft of one of said two rollers, and a second conversion mechanism that converts the driving force of said drive source into a driving force of changing a position of another end of said shaft, wherein said first conversion mechanism is a first cam that rotates about a rotation shaft by the driving force of said drive source so as to convert the driving force of said drive source into the driving force of changing the position of the one end of said shaft, said second conversion mechanism is a second cam that rotates about said rotation shaft together with said first cam by the driving force of said drive source so as to convert the driving force of said drive source into the driving force of changing the position of the other end of said shaft, and shapes of said first cam and said second cam when viewed from a direction of said rotation shaft are different.

13. The image forming apparatus according to claim 1, the apparatus further comprising:

a display that displays a calculation result obtained by said hardware processor.

14. A non-transitory computer-readable storage medium storing a control program for an image forming apparatus which includes a driver that presses and separates two rollers via a belt and a detector that detects a position of said belt in an axial direction of one roller of said two rollers, the control program causing a computer to perform:

a process having a procedure of calculating, based on a detection result by said detector, a first movement amount of the position of said belt in said axial direction when said belt is made to travel for a predetermined time in a state where said two rollers are separated and a second movement amount of the position of said belt in said axial direction when said belt is made to travel for a predetermined time in a state where said two rollers are pressed; and calculating at least one of parallelism between said two rollers and a gradient of a pressure in said axial direction of said two rollers based on said first movement amount and said second movement amount.

15. A control method of an image forming apparatus which includes a driver that presses and separates two rollers via a belt and a detector that detects a position of said belt in an axial direction of one roller of said two rollers, the method comprising:

calculating, based on a detection result by said detector, a first movement amount of the position of said belt in said axial direction when said belt is made to travel for a predetermined time in a state where said two rollers are separated and a second movement amount of the position of said belt in said axial direction when said belt is made to travel for a predetermined time in a state where said two rollers are pressed; and calculating at least one of parallelism between said two rollers and a gradient of a pressure in said axial direction of said two rollers based on said first movement amount and said second movement amount.

* * * * *